US005774777A

United States Patent [19]

Ohtsuka et al.

[11] Patent Number: 5,774,777

[45] Date of Patent: Jun. 30, 1998

[54] CONTINUOUS RECORDING MEDIUM FRICTION-CONVEYING MECHANISM IN IMAGE FORMING APPARATUS

[75] Inventors: Hidefumi Ohtsuka, Ibaraki-ken; Shigeru Obata, Ishioka; Junichi Matsuno, Tsuchiura; Yasuyuki Tsuji, Hitachinaka; Shuho Yokokawa, Mito; Isao Nakajima; Muneyoshi Akai, both of Hitachinaka; Yoji Hirose, Mito, all of Japan

[73] Assignees: Hitachi, Ltd.; Hitachi Koki Co., Ltd., both of Tokyo, Japan

[21] Appl. No.: 774,446

[22] Filed: Dec. 30, 1996

[30] Foreign Application Priority Data

Jan. 8, 1996 [JP] Japan ..... 8-000828
Jan. 10, 1996 [JP] Japan ..... 8-002031

[51] Int. Cl.[6] ..... G03G 15/00

[52] U.S. Cl. ..... 399/384; 271/228; 399/395

[58] Field of Search ..... 399/23, 19, 384, 399/388, 394, 395, 397, 22, 312; 271/226, 227, 228, 236, 238, 243, 244, 249, 252, 253

[56] References Cited

U.S. PATENT DOCUMENTS

| | | | |
|---|---|---|---|
| 3,865,480 | 2/1975 | Swanberg | 399/384 |
| 4,987,448 | 1/1991 | Chikama | 399/395 X |
| 5,068,693 | 11/1991 | Nagakura et al. | 399/22 |
| 5,432,593 | 7/1995 | Nishikawa et al. | 399/384 X |
| 5,471,290 | 11/1995 | Nagayama et al. | 271/228 X |
| 5,481,352 | 1/1996 | Yamamoto et al. | 399/384 |
| 5,585,910 | 12/1996 | Jamzadeh et al. | 399/312 |

FOREIGN PATENT DOCUMENTS 4-256654 9/1992 Japan .

*Primary Examiner*—S. Lee
*Attorney, Agent, or Firm*—Antonelli, Terry, Stout & Kraus, LLP

[57] ABSTRACT

An image forming apparatus includes a feed roller mechanism disposed downstream of a transfer corotron 412 constituting a transfer section and composed of driven rollers 506 located on both edges of a continuous recording medium 100 which are outside an image transfer area and a drive roller 508 extending over the whole width of the continuous recording medium 100, so that when transferring a toner image from an image recording member 402, on which the toner image is to be formed, to the continuous recording medium 100, friction by the rollers achieves reliable conveyance against an attraction between the image recording member 402 and the continuous recording medium 100 without disturbing an unfixed image on the continuous recording medium 100. The image forming apparatus further includes a line sensor 43 for detecting a position where a reference edge of the recording medium is present, a line sensor output device which judges a position of the recording medium reference edge in cooperation with the line sensor to send a recording medium reference edge position signal or mask 61 adjustable in position for shielding a portion of a detection window of the line sensor, a recording medium position correction device 11 which finds a recording medium position correction value from an output of the line sensor for carrying out feedback control, and a guide 38 for preventing rising of the recording medium.

16 Claims, 12 Drawing Sheets

CONTINUOUS RECORDING MEDIUM FRICTION-CONVEYING MECHANISM IN IMAGE FORMING APPARATUS

BACKGROUND OF THE INVENTION

This invention relates to an image forming apparatus for recording electrophotographically an image on a continuous recording medium such as paper, plastic sheet film and the like, and more particularly to an image forming apparatus which is provided with means for friction-conveying a continuous recording medium with reliability to make it possible to correct skew of the recording medium to be conveyed.

In sprocket hole type paper conveyance which has been a general continuous paper conveying system, paper is conveyed by means of engagement of sprocket holes at both edges of the paper with sprocket pins, and therefore deformation and breakage of the sprocket holes have been taken notice but no attention has been given to an attraction for paper in a transfer section of an electrophotographic image forming apparatus until now.

For continuous paper, the sprocket hole type paper conveyance is advantageous in that feeding is reliable to a certain extent and skew is not accumulated but, on the other hand, there has been a problem that the necessity of forming sprocket holes in both edges of paper restricts the freedom of selection of paper as well as causes the cost to increase.

There have been put to practical use various types of image forming apparatus in which a continuous image recording medium is conveyed due to friction conveyance with rollers to an image recording section where image recording is performed. From the viewpoint of the conveyance of the continuous recording medium with rollers, it is a problem to detect and correct widthwise shift caused by skew of the recording medium. To cope with this, several technologies have been disclosed. For example, a literature (Precision Machinery, Vol. 47, No. 4: PP. 32–37, Nishimura; Skew Correction in Roller Paper Feed Mechanism) discloses an image forming apparatus in which a continuous paper is conveyed due to friction conveyance with rollers to an image recording section where image recording is performed, and a skew correction method in which feedback control is carried out in such a manner that widthwise shift of the paper is detected by a sensor provided at an edge of the paper and transmitted to skew correction means. Further, Japanese Patent Unexamined Publication No. 4-256654 discloses a method in which rolled paper is used as continuous paper and skew of the rolled paper is detected and corrected.

The above literature makes no reference to the friction conveyance of recording medium in cases where a transfer section is of the type that a toner image is transferred using a so-called electrophotographic image recording technique. In the electrophotographic image forming apparatus, an electrostatic latent image on a photosensitive member is developed with charged toner, and electric charge of a polarity opposite to that of the charged toner is applied from a surface of a recording medium opposite to that facing a toner image in a transfer section, so that the toner image is transferred onto the recording medium due to Coulomb force or electrostatic force. At this time, since the recording medium itself is charged as well, it is attracted by Coulomb force to the photosensitive member surface on which the toner image is not formed, that is, the photosensitive member surface charged to the same polarity as the toner. In cases where the rate of printing is high so that lots of imaging toner is on the photosensitive member, since the attraction area between the recording medium and the photosensitive member is small the attraction is made small. However, in cases where the rate of printing is low, the attraction area between the recording medium and the photosensitive member becomes large, so that the force of attraction exerted by the photosensitive member on the recording medium is large. This attraction works as load on the friction conveyance of the recording medium, which causes slip in the friction-conveying section to thereby exert bad influences upon the normal friction conveyance.

The above literature of "Skew Correction in Roller Paper Feed Mechanism" refers to the paper skew correction carried out by detecting an edge of a uniform continuous paper which is formed with neither sprocket hole nor widthwise perforated line. However, the actual image recording paper is very often formed with sprocket holes for the paper conveyance purpose and perforated lines for the purpose of cutting off the continuous paper into sheets. It is advisable for the image forming apparatus to be available switchably to both the paper with sprocket holes and the paper with no sprocket hole. In the case of paper with sprocket holes, signals are generated at two points, that is, at the real edge of the paper and at the edge of the sprocket hole, and therefore it is necessary to make sure that the signal corresponds to the real edge of the paper in order to use as the paper skew correction information. Besides, the paper with perforated lines is very likely to rise in the vicinity of the paper edge detecting means to thereby make error appear in the paper edge detection value. According to the method disclosed in Japanese Patent Unexamined Publication No. 4-256654, on sensing the skew, skew correction means is operated to correct the skew, and however the paper can not be used while the skew correction means is being operated. It is therefore necessary to rewind the paper for eliminating this waste.

SUMMARY OF THE INVENTION

An object of the present invention is to provide an image forming apparatus for forming electrophotographically an image on a continuous recording medium in which the recording medium is conveyed reliably and accurately to prevent any defective portion from appearing in the recorded image.

Another object of the present invention is to provide an electrophotographic image forming apparatus having means for friction-conveying a continuous recording medium such as paper with no sprocket hole, plastic sheet film and the like with reliability.

Still another object of the present invention is to provide an image forming apparatus in which position of paper edge is detected accurately whether sprocket hole is formed or not, and skew correction is performed continuously through feedback control before reaching an image recording section while preventing the paper from rising even if it is formed with perforated lines, thereby preventing any unrecordable portion from appearing in the paper.

In order to achieve the above objects, according to the present invention, there is provided an image forming apparatus comprising recording medium conveying means for friction-conveying a continuous recording medium, an image recording section for forming electrostatically a toner image, and a transfer section for transferring the toner image to the recording medium, wherein the recording medium conveying means includes friction-conveying means provided downstream of the transfer section with respect to a recording medium conveying direction for interposing therebetween and conveying the recording medium, and said apparatus further comprising a line sensor for detecting the position where a reference edge of the recording medium is present, a recording medium position correction means control device for outputting control signal in association with the line sensor, and recording medium position correction means disposed upstream of the image recording section with respect to the recording medium conveying direction for correcting a position of the image recording medium edge on receiving a signal from the recording medium position correction means control device.

In an aspect, the present invention provides an image forming apparatus comprising recording medium conveying means for friction-conveying a continuous recording medium, an image recording section for forming electrostatically a toner image, and a transfer section for transferring the toner image to the recording medium, wherein the recording medium conveying means includes friction-conveying means for interposing therebetween and conveying the recording medium, which is provided downstream of the transfer section with respect to a recording medium conveying direction and comprises two rollers located on both edges of the recording medium which are outside an image transfer area and a roller disposed on a back side of a surface of said recording medium onto which an image is to be transferred.

In another aspect, the present invention provides an image forming apparatus comprising recording medium conveying means for friction-conveying a continuous recording medium, an image recording section for forming electrostatically a toner image, and a transfer section for transferring the toner image to the recording medium, wherein the recording medium conveying means includes friction-conveying means for interposing therebetween and conveying the recording medium, which is provided downstream of the transfer section with respect to a recording medium conveying direction and comprises two rollers located on both edges of the recording medium which are outside an image transfer area and a roller disposed on a back side of a surface of said recording medium onto which an image is to be transferred, the two driven rollers, respectively, have pressing means by which the driven roller is pressed against the drive roller.

In still another aspect, the present invention provides an image forming apparatus comprising an image recording section including a photosensitive member on which a Loner image is to be formed electrophotographically, a charging member for uniformly charging the photosensitive member, an optical member for forming an electrostatic latent image on the photosensitive member and a developing member for developing the latent image with toner, recording medium conveying means for friction-conveying a continuous recording medium, and a transfer section for transferring the toner image to the recording medium, wherein the recording medium conveying means includes friction-conveying means for interposing therebetween and conveying the recording medium, which is provided downstream of the transfer section with respect to a recording medium conveying direction and comprises two rollers located on both edges of the recording medium which are outside an image transfer area and a roller disposed on a back side of a surface of the recording medium onto which an image is to be transferred, the two driven rollers each have pressing means by which the driven roller is pressed against the drive roller, and each of the pressing means has a pressing force of not less than $\mu d \cdot Fq/(\mu r \cdot \cos\theta)$ relative to an attraction Fq between the recording medium and the photosensitive member, on the assumption that $\theta$ is an angle between a tangential direction of the photosensitive member and the recording medium conveying direction in the transfer section, $\mu d$ is a coefficient of friction between the recording medium and the photosensitive member, and $\mu r$ is a coefficient of friction between the recording medium and the drive roller.

In a further aspect, the present invention provides an image forming apparatus comprising a line sensor for detecting a position where a reference edge of a recording medium is present, line sensor output processing means which judges the position of the recording medium reference edge in cooperation with the line sensor to send a recording medium reference edge position signal, a recording medium position correction means control device which finds a recording medium position correction value from an output of the line sensor output processing means so as to output a control signal, and recording medium position correction means disposed upstream of an image recording section with respect to a recording medium conveying direction for correcting the position of the image recording medium edge on receiving the signal from the recording medium position correcting means control device.

In a still further aspect, the present invention provides an image forming apparatus comprising a line sensor disposed upstream of an image recording section with respect to a recording medium conveying direction for detecting a position where a reference edge of a recording medium is present, mask means adjustable in position for shielding a portion of a detection window of the line sensor, a recording medium position correction means control device which finds a recording medium position correction value from an output of the line sensor so as to output a control signal; and recording medium position correction means disposed upstream of the image recording section with respect to the recording medium conveying direction for correcting a position of the image recording medium edge on receiving the signal of the recording medium position correction means control device.

DESCRIPTION OF THE PREFERRED EMBODIMENTS

An image forming apparatus according to the present invention will be described taking the case of a laser-beam printer in this specification, and however the invention is not limited to the laser-beam printer. The present invention is applicable to every image forming apparatus of the type that an electrostatic latent image is developed with toner to form a toner image which in turn is transferred to a recording medium.

Figure 1:
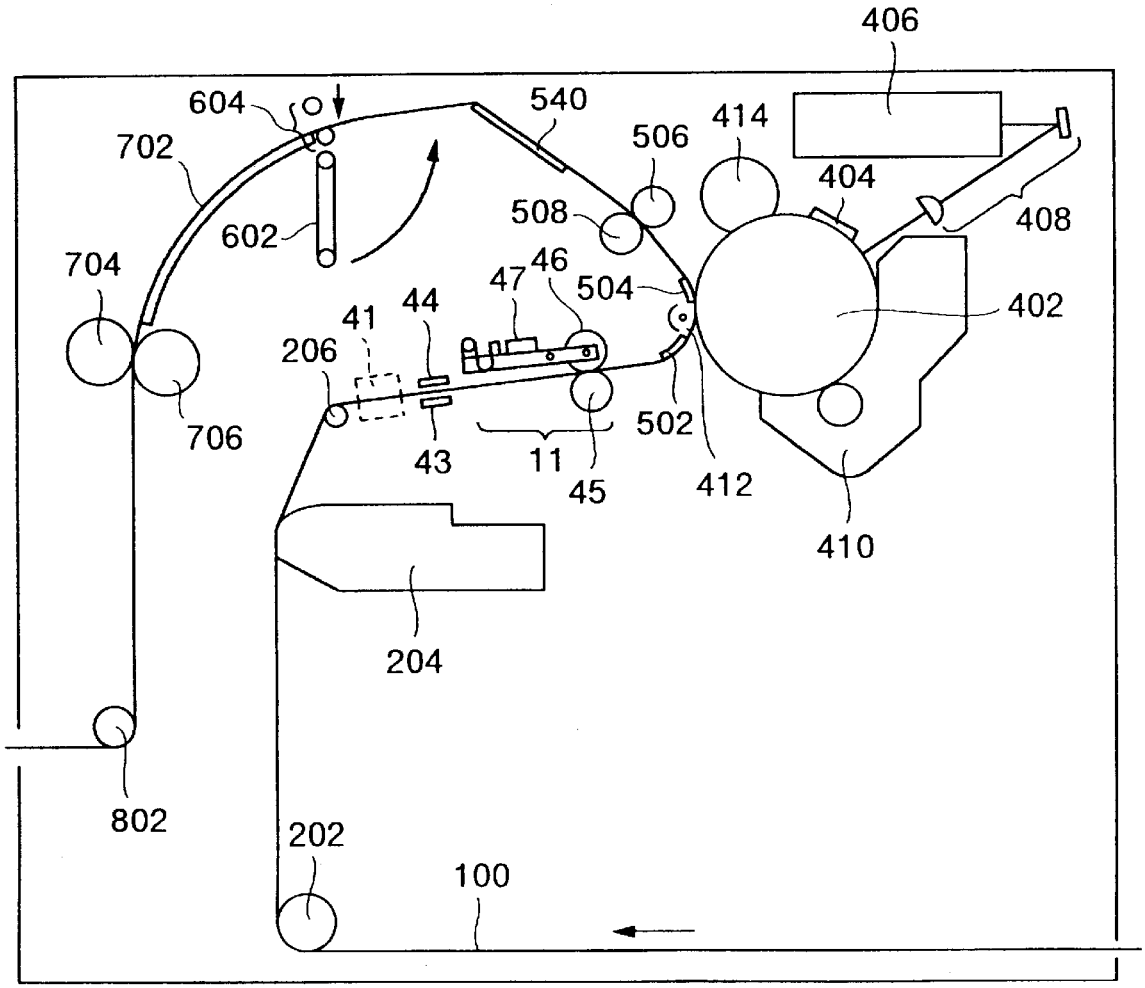
FIG. 1 is a sectional view showing a structure of a laser-beam printer as an image forming apparatus according to a first embodiment of the present invention.
Figure 2:
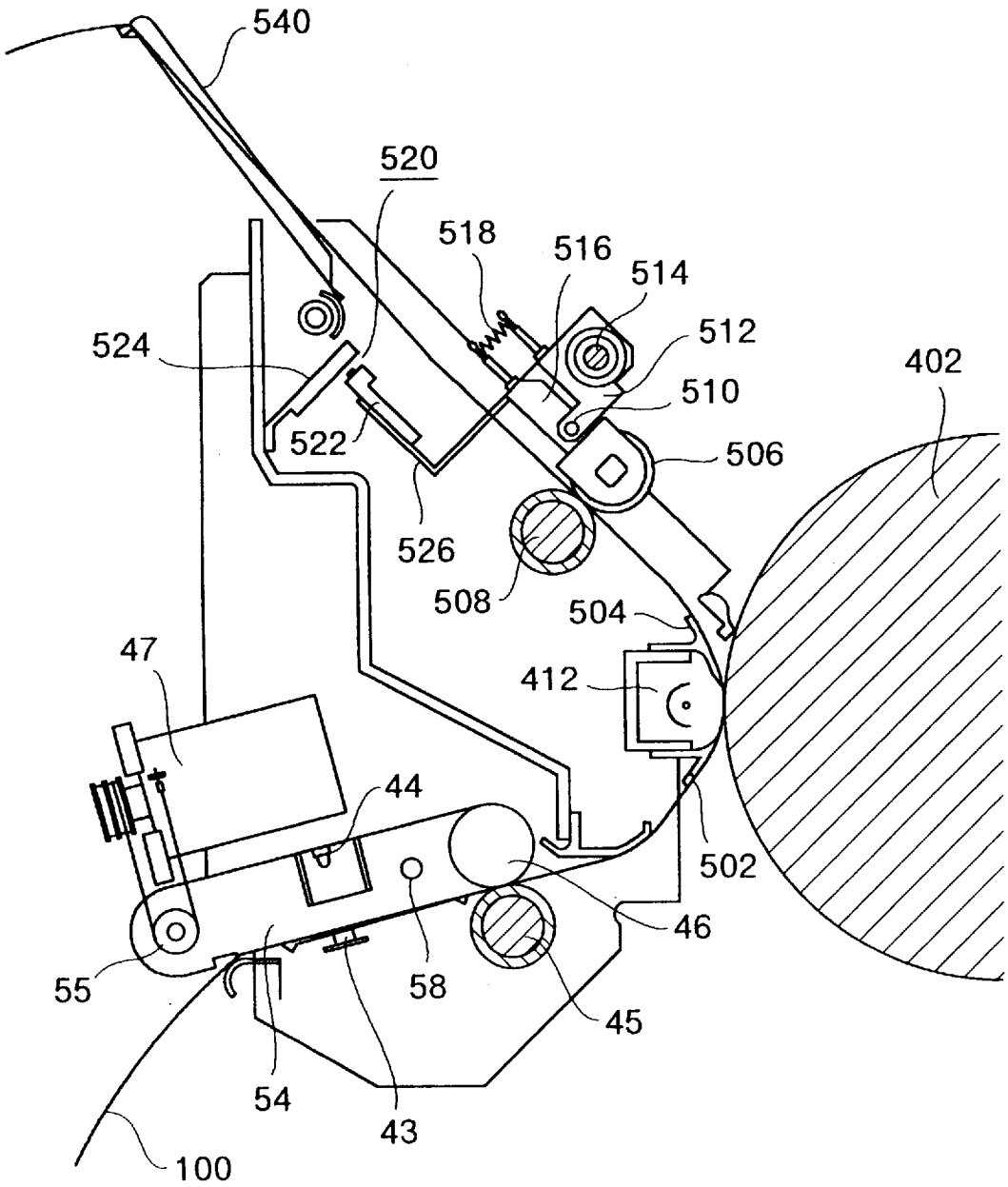
FIG. 2 is a sectional view showing an example of the structure of a recording medium conveying section in the image forming apparatus of FIG. 1.
Figure 3:
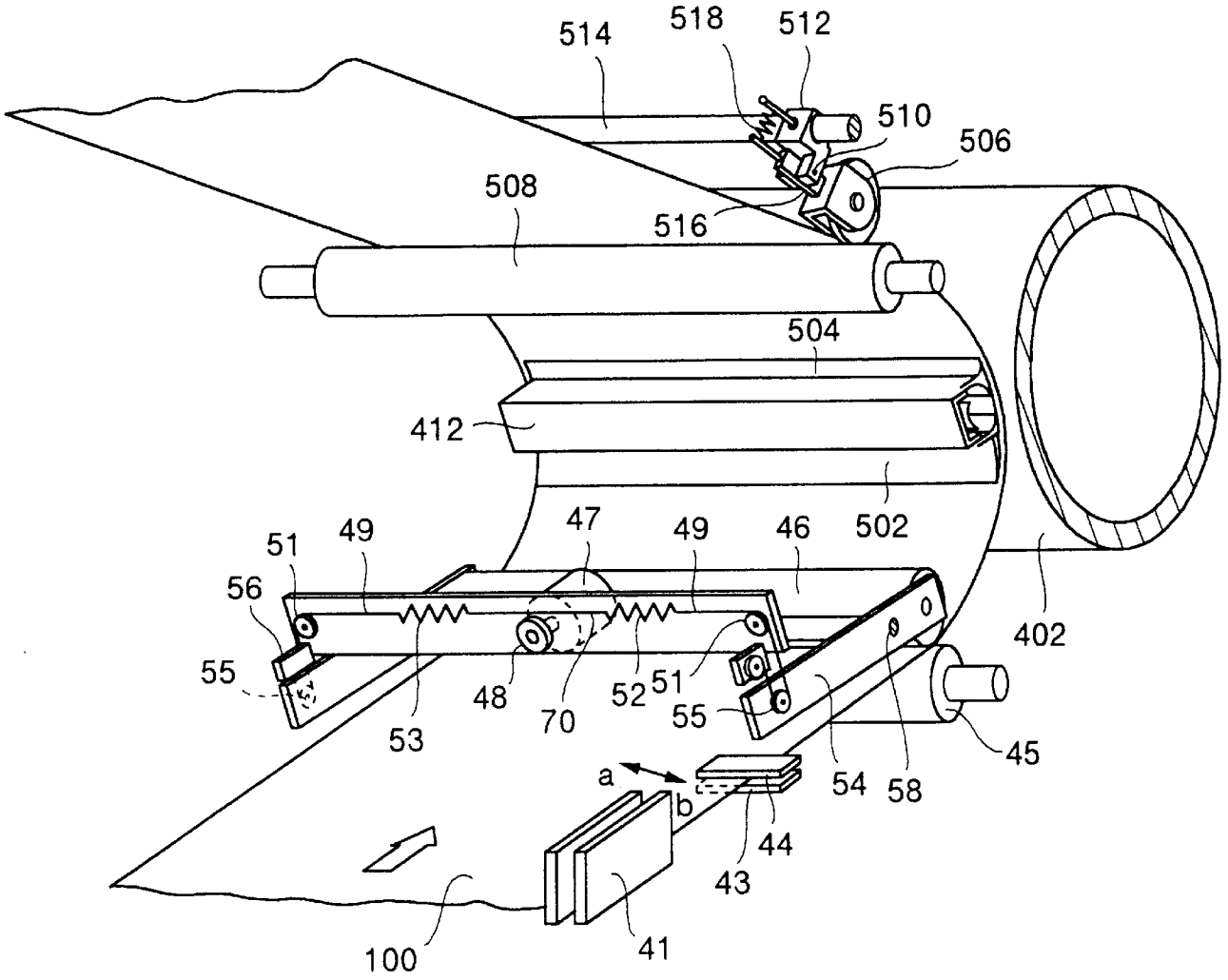
FIG. 3 is a perspective view showing the recording medium conveying section in the image forming apparatus of FIG. 2.

Now, description will be given of an image forming apparatus according to a first embodiment of the present invention with reference to FIGS. 1 to 3. FIG. 1 is a sectional view showing a structure of a laser-beam printer as an image forming apparatus according to the first embodiment of the invention, FIG. 2 is a sectional view showing an example of the structure of a recording medium feeding or conveying section in the image forming apparatus of FIG. 1, and FIG. 3 is a perspective view showing the recording medium conveying section in the image forming apparatus of FIG. 2.

FIG. 1 is a sectional view of an image forming apparatus according to the first embodiment of the present invention. In order to record a toner image on a recording medium 100 which is fed continuously, an electrostatic latent image is first formed on a photosensitive drum 402. The photosensitive drum 402 constituted by coating a surface of metallic drum with a photosensitive layer is rotatably supported. As the photosensitive drum 402 is rotated, the surface thereof is uniformly charged by a charger 404 disposed near the outer periphery of the photosensitive drum 402, and is then irradiated with a laser beam, which is turned on and off in response to image signals generated from a laser emitting portion 406, through an optical member 408 including mirror and lens. Thus, an electrostatic latent image is formed on the surface of the drum. This electrostatic latent image is visualized with toner applied by a developing unit 410 disposed near the outer periphery of the photosensitive drum 402, and a toner image is transferred onto the recording medium 100 with a transfer corotron 412. The toner still remaining on the surface of the photosensitive drum 402 after the transfer of the toner image onto the recording medium 100, is removed by a drum cleaner 414 disposed near the outer periphery of the photosensitive drum 402. The surface of the drum from which the toner has been thus removed arrives at the charger 404 and repeatedly undergoes uniform charging, electrostatic latent image formation, toner image visualization, transfer, and toner removal as the photosensitive drum 402 is rotated.

A recording medium feeding or conveying section for feeding or conveying a continuous recording medium 100 comprises an auxiliary roller 202 for turning and guiding the recording medium 100 fed from a recording medium supply means (not shown), a discharge guide 204 having a discharge brush at an end portion thereof with which the recording medium 100 is brought into contact, another auxiliary roller 206, a guide 41 for regulating a position of a widthwise edge of the recording medium 100 on occasions when the recording medium 100 is first loaded in the recording medium conveying section, a detection means including a line sensor 43 such as a CCD image sensor and a light source (LED light source) 44 therefor and detecting widthwise shift of the recording medium 100, a recording medium position correction means 11 for correcting widthwise shift of the recording medium 100, a recording medium guide 502, another recording medium guide 504 disposed downstream of the transfer corotron 412 in the transfer section described above, feed rollers including driven rollers 506 provided on both ends of the recording medium 100 which are outside an image transfer area so as to be prevented from making contact with a transferred image on the recording medium 100 and a drive roller 508 extending over the whole width of the recording medium 100, a tensioner 540 for giving a constant tension to the recording medium 100, a recording medium feed belt 602 which is moved in the direction of an arrow to feed downstream a leading end of the recording medium 100 at the time of setting the recording medium 100 at first, a pair of auxiliary feed rollers 604, and still another auxiliary roller 802 provided downstream of a fixing section for guiding the recording medium 100 to the outside of the apparatus.

The fixing section comprises a heat panel 702, a heat roller 704 and a backup roller 706 so that the toner of the transferred image on the recording medium 100 is heated and pressed at a predetermined temperature to be fixed.

Figure 6:
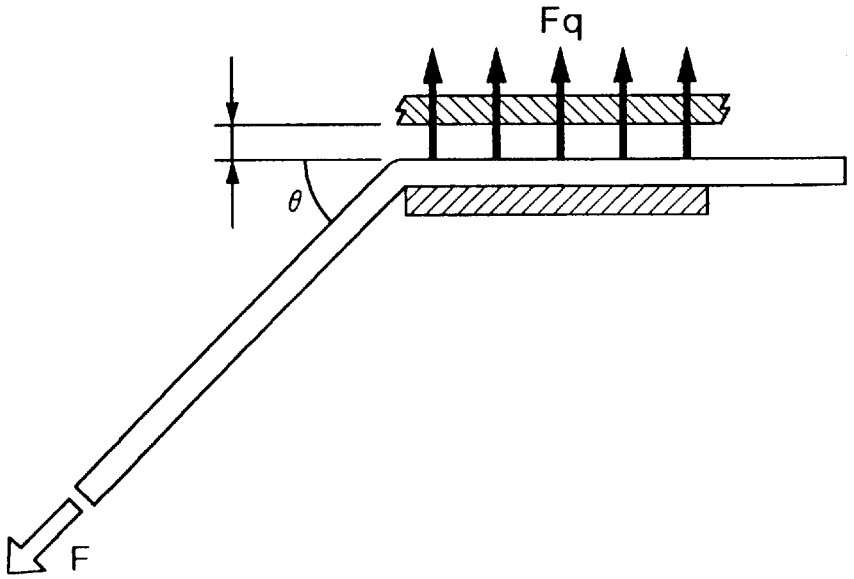
FIG. 6 is an illustration of an example of a model based on which, according to the present invention, an attraction between a toner image forming member or a photosensitive member and a recording medium in a transfer section is computed.

FIG. 6 is an illustration of an example of a model based on which, according to the present invention, an attraction between the toner image forming member or the photosensitive member and the recording medium in the transfer section is computed. In the model for computation shown in FIG. 6, it is assumed that the recording medium is a dielectric with a dielectric constant of 2.9, the transfer member at the back side of the recording medium is a uniform electrode, and the surface of the photosensitive member is uniformly charged. Based on this model for computation, a relation between a gap between a recording medium and a photosensitive member and a force or an attraction exerted by the photosensitive member on the recording medium was computed.

Figure 7:
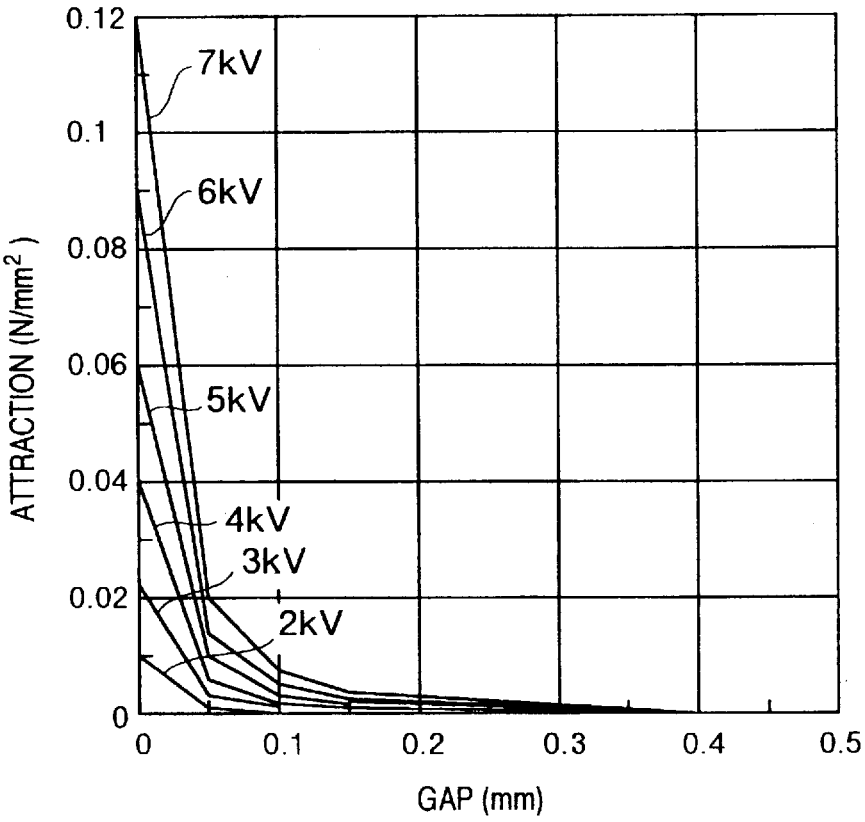
FIG. 7 is a graph showing the results of the computation of attraction conducted in accordance with the model of FIG. 6.

FIG. 7 is a graph showing the results of the computation of attraction conducted in accordance with the model of FIG. 6. In FIG. 7, the gap between a recording medium and a photosensitive member is taken as the abscissa, while the attraction per unit area is taken as the ordinate using the potential difference between a surface of the photosensitive member and a transfer member as a parameter. In the transfer section, the recording medium and the photosensitive member are brought into contact with each other through the toner, and therefore the gap is not more than 0.05 mm at the maximum. Meanwhile, the preset potential difference between the surface of photosensitive member and the transfer member depends on developing conditions and a recording speed of the image forming apparatus, and is expected to be about 2 kv to 7 kV. Accordingly, the attraction fq in the transfer section comes to 0.0016 to 0.12 $N/mm^2$. An actual attraction Fq is a product of this value and a transfer area S. A force by which the recording medium is conveyed in the direction tangent to the photosensitive member is expressed by F·cos θ, assuming that F is a tension in the recording medium conveying direction and θ is an angle between the tangential direction of the photosensitive member and the recording medium conveying direction in the transfer section. Therefore, a required tension F is expressed as follows:

$$F>\mu d\cdot Fq/\cos\theta$$

$$\therefore F>\mu d\cdot fq\cdot S/\cos\theta$$

where μd is a coefficient of friction between the recording medium and the photosensitive member.

Accordingly, the pressing force P of driven rollers is given as follows because of F=μr·P:

$$P>\mu d\cdot Fq/(\mu r\cdot\cos\theta)$$

where μr is the coefficient of friction between drive roller of conveying means and the recording medium.

For example, in the event that the gap between the surface of the photosensitive member and the transfer member is 0.05 mm, he preset potential difference is 6 kV, the width and length of the transfer member is 13.5 mm in width and 17 inches (431.88 mm) in length, respectively, a transit angle θ of the recording medium is 45°, and in the case of μd=1, F>120 N comes out. If a coefficient of friction between the drive roller of the recording medium conveying means disposed downstream of the transfer section with respect to the recording medium conveying direction and the recording medium is set to meet μr=1, friction feed can be reliably performed against the attraction between the toner image forming member and the recording medium in the transfer section, provided that the preset pressing force of the two driven rollers is made to be not less than 120 N.

Referring to FIGS. 1 to 3, description will now be given of the details of the recording medium conveying section of the image forming apparatus according to the embodiment of the present invention.

Recording medium conveying section of this embodiment adopts a system for friction-conveying the recording medium 100 using the edge of the recording medium 100 as a reference. At the end of the area through which the recording medium 100 is made to pass, detection means comprising a line sensor 43 and an LED light source 44, and a guide 41 are mounted to a case (not shown). The line sensor 43 is mounted in such a manner that the approximately center of a sensing portion thereof is aligned with a position a of the guide 41 for regulating the position of the widthwise edge of the recording medium 100. A solenoid which moves linearly in opposite directions is provided at the bottom of the guide 41. Driving of the solenoid causes the guide 41 to move between the positions a, b shown in FIG. 3. It is desired that the guide 41 withdraws to the position b at the time of printing.

An output of the line sensor 43 which detects the position of the edge of the recording medium 100 is inputted into position correction value computing means (not shown). The position correction value computing means computes a position correction value which is inputted into position correction control means (not shown). The position correction control means outputs a control signal to a control motor 47 of the position correction means 11 to produce a difference between the pressing forces applied to opposite ends of a correction roller 46 provided to extend over the width of the recording medium 100.

The correction roller 46 cooperates with a drive roller 45 in conveying the recording medium 100, which has been corrected in position, to the transfer section.

In the recording medium conveying section, it is necessary to perform the friction conveyance with the rollers so that the recording medium 100 can be fed whether or not it is formed with sprocket holes which might be arranged on the edge of the recording medium 100. As shown in FIGS. 2 and 3, a drive roller 508 is provided for feeding the recording medium 100 while rotatingly contacting, over the entire width of the recording medium, with the surface of the recording medium opposite to that with a transferred image thereon, and driven rollers 506 are provided for assisting the driving of the recording medium by interposing between it and the drive roller 508, only the opposite edges of the recording medium in such a manner that they are brought into contact with the surface with the transferred image thereon but not into contact with the transferred image. The driven rollers 506 are each rotatably supported by a holder 516. The holder 516 is joined with a pin 510 to a driven roller carrier 512 which is mounted on a driven roller shaft 514 supported by side plates (not shown) so as to be linearly movable thereon. It is therefore possible to move the driven roller 506 for adjusting the widthwise position thereof in accordance with the width of the recording medium 100. However, the driven roller carrier 512 located on the same side as the reference edge of the recording medium may be fixed in position on the driven roller support shaft 514. The driven roller carrier 512 and the holder 516 are each formed with a projection on the end thereof remote from the driven roller 506, and the both projections are tied by a tension spring 518. This causes the driven roller 506 to be pressed against the drive roller 508 about the pin 510 by which the holder 516 is joined to the driven roller carrier 512. Accordingly, as the drive roller 508 is driven, the driven roller 506 is caused to move with the recording medium 100, with the result that the driven roller is rotated. As shown in FIG. 2, a driven roller position sensor moving portion 522 is held at an end of a moving portion support member 526 of a driven roller position sensor 520 which is fixed to an end surface of the linearly movable driven roller carrier 512 on the driven roller support shaft 514, and a driven roller position sensor stationary portion 524 is disposed in opposed relation to the moving portion 522. The driven roller position sensor moving portion 522 is constructed such that a magnet is fixed at an end of a magnet holder, while the driven roller position sensor stationary portion 524 is constructed such that a large number of magnetic detecting elements capable of detecting the magnetic force of the magnet provided on the driven roller position sensor moving portion 522 are arranged on the surface of a substrate disposed perpendicularly to the recording medium 100 and parallel with the driven roller support shaft 514. On adjusting the position of the driven roller 506 in accordance with the recording medium 100 to be used, the driven roller position sensor 520 detects the width of the loaded recording medium 100 and transmits information to a printer control circuit for controlling the image recording mechanism and a paper position correction means control device. The drive roller 508 is rotatably mounted to side plates (not shown) and driven by a motor (not shown) in the same manner as the upstream drive roller 45.

The pressing force by which the driven roller 506 is pressed against the driven roller 508 is set to be not less than μd·Fq/(μr·cos θ) relative to the attraction Fq between the recording medium 100 and the photosensitive drum 402 when no toner image is formed on the photosensitive drum 402, that is, when the rate of printing is 0%, on the assumption that θ is an angle between the tangential direction of the photosensitive drum 402 and the recording medium conveying direction in the transfer section, $\mu d$ is a coefficient of friction between the recording medium 100 and the photosensitive drum 402, and $\mu r$ is a coefficient of friction between the recording medium 100 and the drive roller 508. In this embodiment, since two driven rollers 506 are provided in the positions where the both edges of the recording medium 100 are made to pass through, the pressing force for one driven roller 506 becomes not less than $\mu d \cdot Fq/(2\mu r \cdot \cos\theta)$.

Meanwhile, there is formed a lever in which the fixing portion of the tension spring 518 serves as a point of force, the pin 510 as a fulcrum and the attaching portion of the driven roller 506 as a point of application, and therefore the pressing force is set in accordance with the product of the strength of tension spring 518 and a ratio of an arm from the fulcrum to the point of force to an arm from the fulcrum to the point of application. This pressing mechanism for each of the driven rollers 506 can set the pressing force independently.

When loading the recording medium 100, the carrier 512 is first moved to move the driven roller 506 to the edge of the recording medium 100. The position of the carrier 512 is detected by the carrier position sensor 520, so that the width of the recording medium 100 to be loaded is inputted into a printer control circuit (not shown) which determines a width of toner image to be formed on the photosensitive drum 402 in accordance with the width of the recording medium 100.

The line sensor 43 provided upstream of the position correction means 11 detects a position of the edge of the recording medium 100 and outputs the same to a position correction value computing means (not shown). The position correction value computing means computes a correction value and outputs the same to the position correction control means (not shown). The position correction control means outputs a control signal for position correction. Based on the control signal, the control motor 47 rotates a predetermined angle to change the tensile force of each of springs 52, 53. Since the tensile forces are transmitted through wire ropes 49, 70, 71 connected to the springs 52, 53 to the points of force of arms 54 each pivotally mounted about a fulcrum 58 while being changed in the direction of force by means of pulleys 48, 51, 55 and the like, a difference between the tensile forces results in a difference between the pressures applied to right and left portions of the driven correction roller 46 mounted to the ends of the arms. This pressure difference causes differences in the conveying force applied widthwise of the recording medium 100, thereby correcting the positional shifting of the recording medium 100. The recording medium 100 having been corrected in positional shift by the position correction means 11 and applied with the conveying force is conveyed to the transfer section.

In the transfer section, the toner image on the photosensitive drum 402 is transferred onto the recording medium 100 by the electrostatic force of the transfer corotron 412. At this time, an attraction attributed to Coulomb force is generated between the recording medium 100 and the photosensitive drum 402. This attraction becomes maximum when no toner image is formed on the photosensitive drum 402, that is, when the rate of printing is 0%.

Assuming that the maximum attraction is represented by Fq, the recording medium 100 is pressed against the drive roller 508 by the driven rollers 506 with a pressing force of not less than $\mu d \cdot Fq/(\mu r \cdot \cos\theta)$, the driven rollers 506 being provided downstream of the transfer section in the positions which are outside the image transfer area and through which the both edges of the recording medium 100 are made to pass so that the driven rollers 506 are not brought into contact with the transferred image on the recording medium 100, and therefore the recording medium 100 can be conveyed smoothly without being affected by the attraction of the photosensitive drum 402 in the transfer section. Incidentally, the driven rollers 506 are pressed on the both ends of the recording medium 100, but the pressing forces applied by them can be set separately from each other, so that it is easy to apply the pressing force uniformly, and therefore the recording medium 100 is never caused to skew due to the unbalanced roller pressing force in the feed roller section which is constituted by the driven rollers 506 and the drive roller 508.

As described above, at least one recording medium conveying means is provided downstream of the transfer section in the recording medium conveying direction, and therefore when transferring the toner image from the image recording portion to the recording medium, the continuous recording medium with no sprocket hole can be friction-conveyed with reliability against the attraction between the toner image forming member and the recording medium. Particularly, friction conveyance is performed by the two rollers located outside the image transfer area of the recording medium, and therefore it is possible to perform the friction conveyance without disturbing the unfixed image on the recording medium.

The recording medium 100 having passed through the feed roller section is fed through the tensioner 540, by which the recording medium 100 is given constant tension, to the fixing section constituted by the heat panel 702, heat roller 704 and backup roller 706, where the toner image is fixed. The recording medium 100 having undergone fixing is caused by the auxiliary roller 802 to turn to be conveyed to a postprocessing section such as a cutter or a reversing device (not shown).

Description will now be given of an image forming apparatus according to a second embodiment of the present invention.

Figure 4:
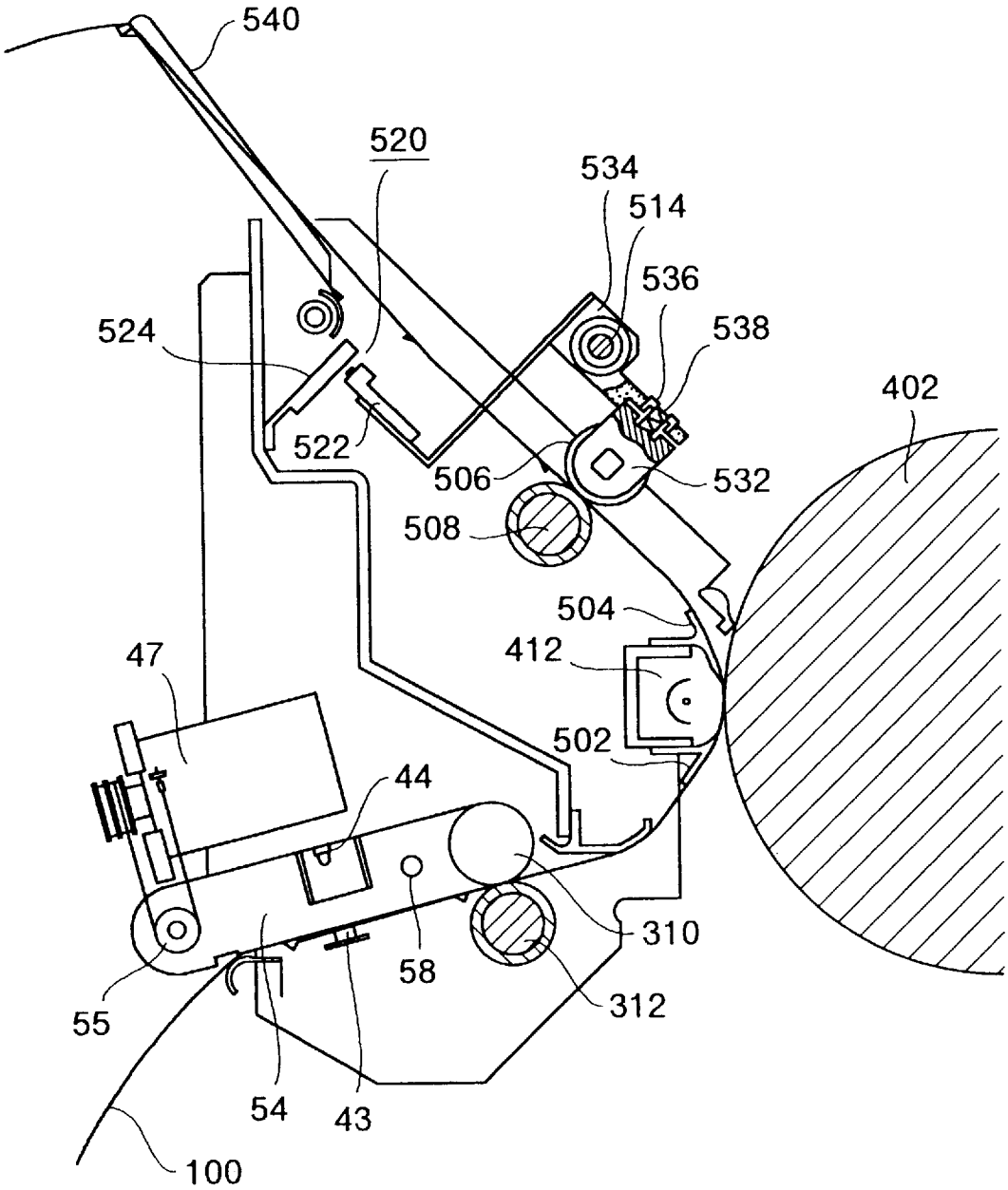
FIG. 4 is a sectional view showing a recording medium conveying section in an image forming apparatus according to a second embodiment of the present invention.
Figure 5:
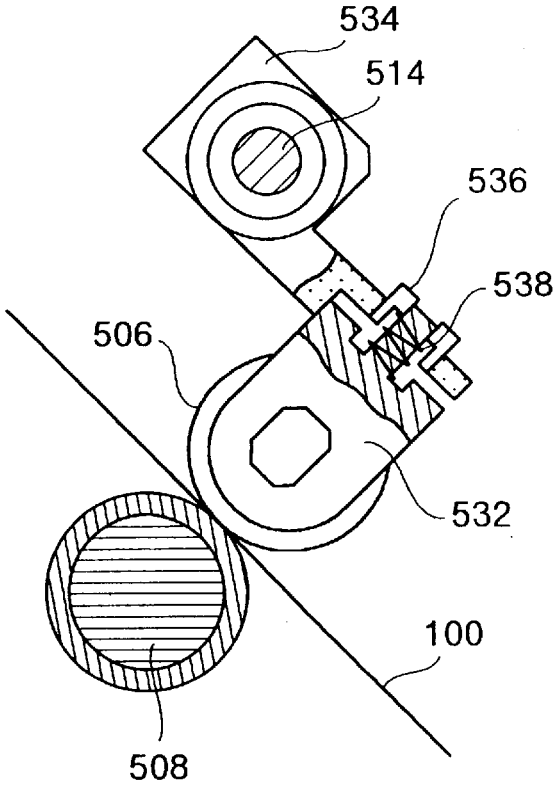
FIG. 5 is an enlarged view of a feed roller section of the recording medium conveying section of FIG. 4.

FIG. 4 is a sectional view showing another example of the structure of the recording medium conveying section of the image forming apparatus of FIG. 1. FIG. 5 is an enlarged view of a feed roller section of the recording medium conveying section of FIG. 4.

The driven rollers 506 provided on both edges of the recording medium 100 so as not to be brought into contact with the transferred image on the recording medium 100, are each supported by a holder 532. A carrier 534 provided to be movable to the right and left on the shaft 514 mounted to the side plates (not shown), is formed with a screw hole. Into this screw hole is fitted a spring holder 536 having an external thread formed on the outer periphery thereof and a hole formed in the central portion thereof. A cylindrical projection of the holder 532 is slidably fitted in the central hole of the spring holder 536 through a compression spring 538 so that the driven roller 506 is pressed against the drive roller 508.

This pressing force is set in the same manner as in the embodiment of FIG. 2. The pressing force is set to be not less than $\mu d \cdot Fq/(\mu r \cdot \cos\theta)$ relative to the attraction Fq between the recording medium 100 and the photosensitive drum 402 when no toner image is formed on the photosensitive drum 402, that is, when the rate of printing is 0%, on the assumption that θ is an angle between a tangential direction of the photosensitive member and a direction in which the recording medium 100 is conveyed in the transfer section, $\mu d$ is a coefficient of friction between the recording medium 100 and the photosensitive member, and $\mu r$ is a coefficient of friction between the recording medium 100 and the drive roller. Since the driven rollers 506 are provided in the positions where the both edges of the recording medium 100 are made to pass, the pressing force for the driven roller 506 on one side becomes not less than $\mu d \cdot Fq/(2\mu r \cdot \cos\theta)$. Incidentally, the position of the driven roller 506 located on the side where the guide 41 is provided for the reference edge of the recording medium 100, may be fixed regardless of the width of the recording medium 100. The carrier 534 is provided with a carrier position sensor 520 for detecting the position thereof so that the width of the recording medium 100 to be loaded is inputted into a printer control circuit (not shown) of the image forming apparatus.

In the pressing mechanism for the driven roller 506 of this embodiment, the spring 538 is adjustable in amount of compression by the rotation of the screw thread on the spring holder 536, and therefore it becomes possible to adjust the pressing force.

Now, description will be given of an image forming apparatus according to a third embodiment of the invention.

Figure 8:
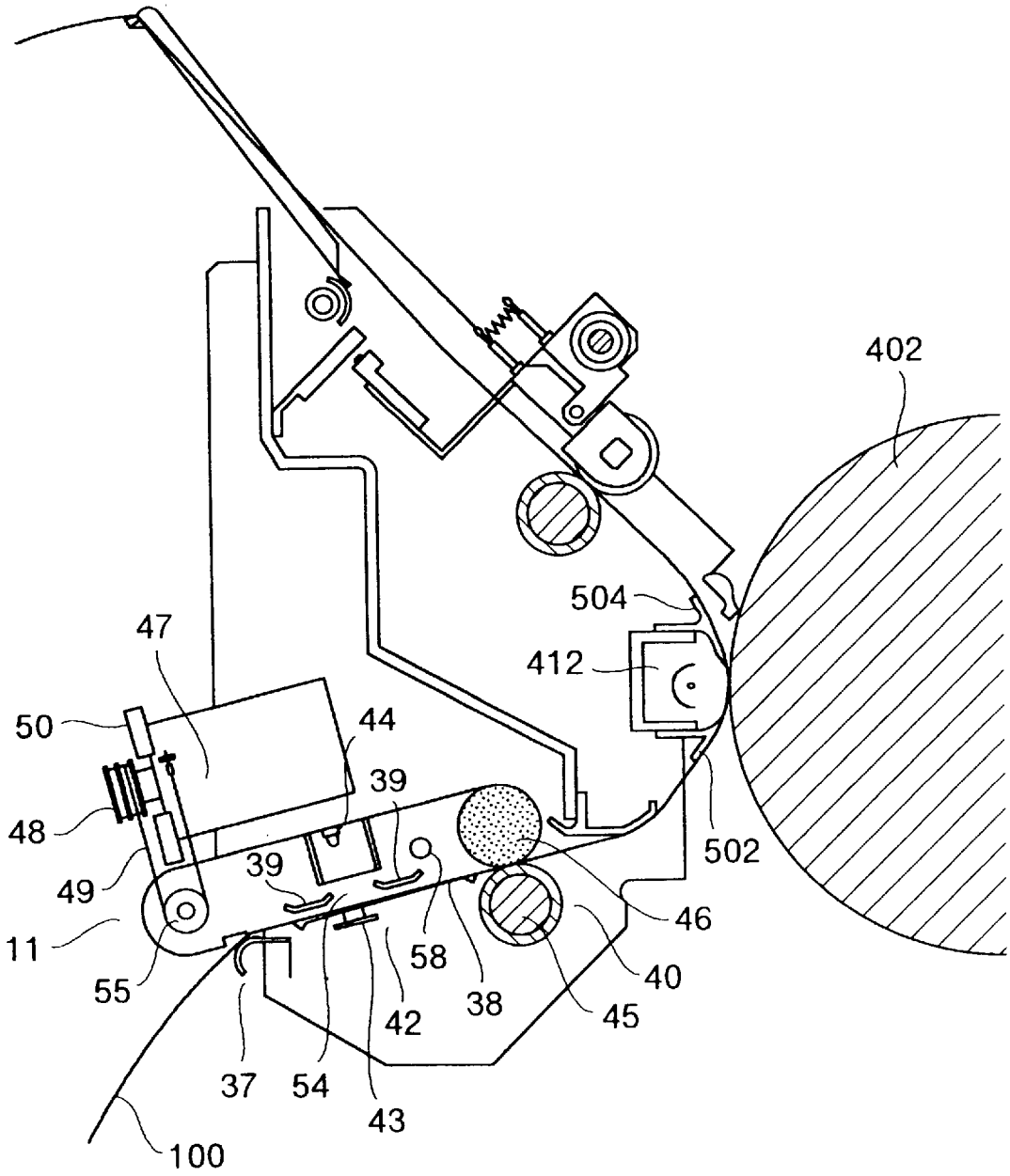
FIG. 8 is a sectional view of a recording medium conveying mechanism according to a third embodiment of the present invention.
Figure 9:
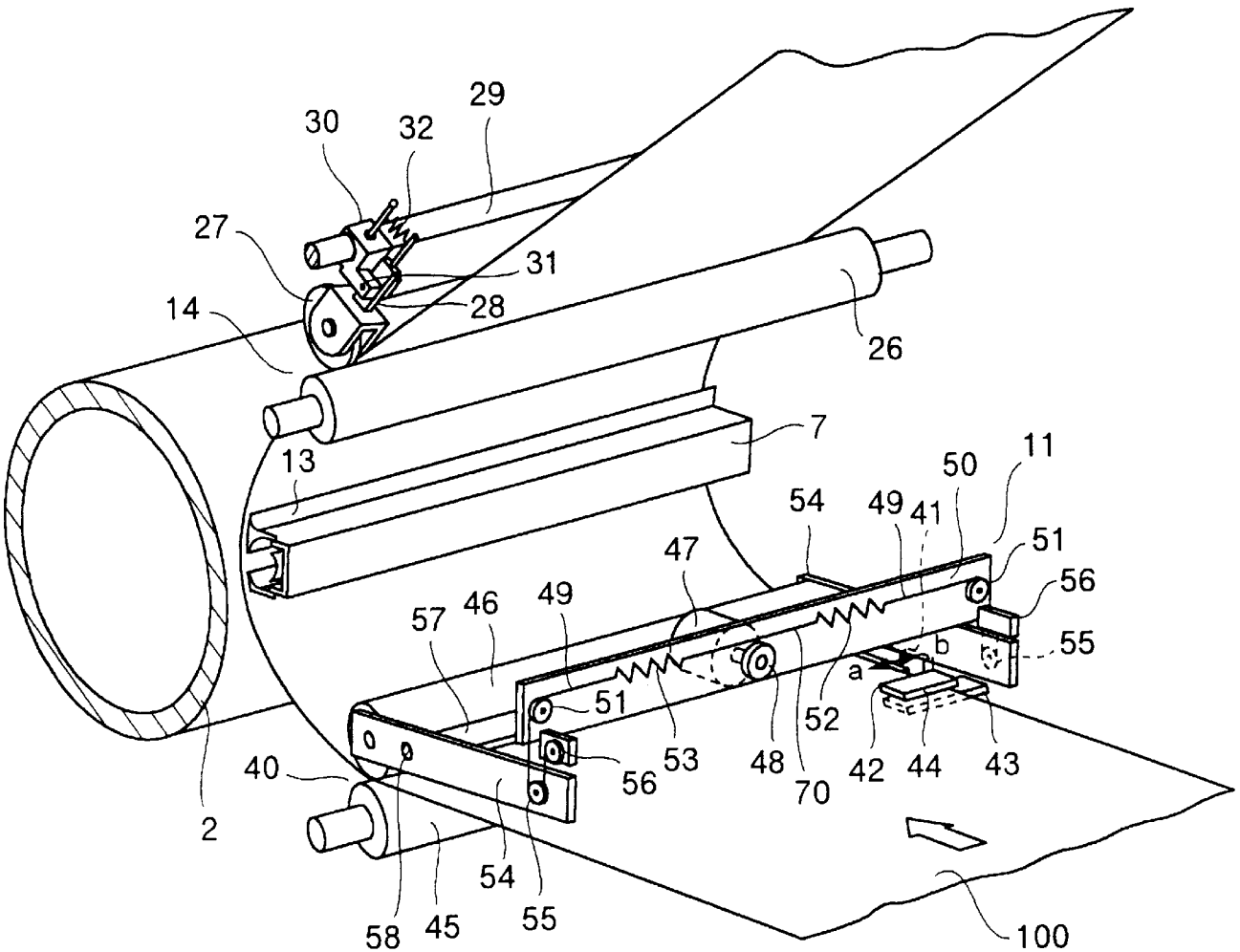
FIG. 9 is a perspective view of the recording medium conveying mechanism according to the third embodiment of the present invention.
Figure 10:
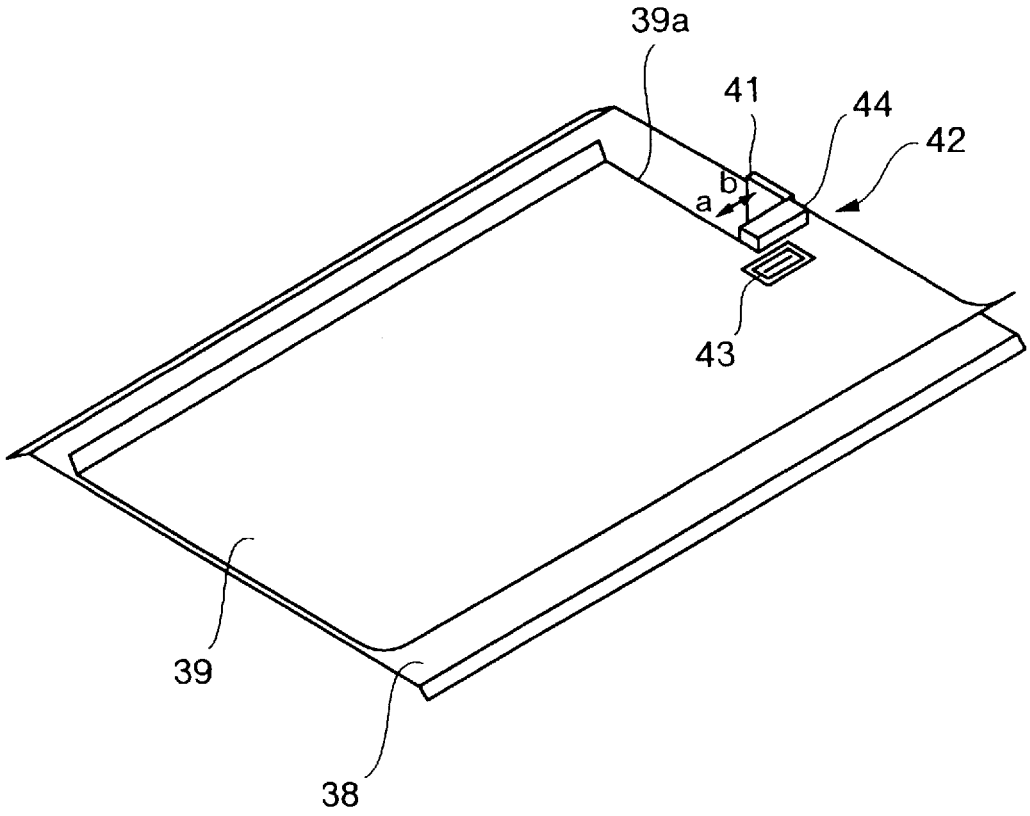
FIG. 10 is a perspective view showing constructions of a line sensor and a recording medium guide.

In this embodiment, a recording medium position correction device 11 feeds the recording medium 100 to a correction roller 40 while guiding the same by means of a correction device upstream recording medium guide 37 at an upstream end, a correction device central recording medium guide 38 at the central portion, and an upper recording medium guide 39 for preventing the recording medium 100 from rising when running. At the edge of the recording medium 100 corresponding to the position of the above-described recording medium reference edge, that is, at the recording medium reference edge, there is provided a recording medium reference edge guide 41 which is movable in the widthwise direction of the recording medium 100 as shown in FIG. 10 so as to regulate the widthwise position of the recording medium 100 at the time of first loading thereof, while a recording medium reference edge position detecting device 42 is provided in the position nearly at the center of which the regulated reference edge of the recording medium is located when the recording medium is moved. The recording medium reference edge position detecting device 42 is a means for detecting a widthwise shift of the recording medium 100 and comprises a line sensor 43 constituted by a CCD (charged coupled device) image sensor and a peripheral circuit and a light source 44 constituted by LED. Based on the fact that the recording medium 100 intercepts light emitted from the light source 44 when the recording medium reference edge passes through between the light source 44 and the line sensor 43, the position of the recording medium reference edge can be detected. Therefore, the detecting device 42 is constructed such that the recording medium reference edge is located nearly at the center of the detecting portion of the line sensor 43 when the recording medium reference edge guide 41 is set in its innermost position (in the position a in FIG. 10). The recording medium reference edge guide 41 is provided at the bottom thereof with a solenoid (not shown) which moves linearly in opposite directions, so as to be movable between a recording medium reference edge position regulating position, that is, a position a in FIG. 10, and a position separated from the recording medium, that is, a position b in FIG. 10. FIG. 10 shows configurations of the correction device central recording medium guide 38, upper recording medium guide 39, recording medium reference edge guide 41, line sensor 43 and light source 44. The recording medium 100 passes through between the correction device central recording medium guide 38 and the upper recording medium guide 39 which are arranged with a distance of several millimeters left between them. The upper recording medium guide 39 is formed with a cut 39*a* in that portion thereof corresponding to the light source 44, while the correction device central recording medium guide 38 is formed with a hole in that portion thereof just above the line sensor 43, and therefore light emitted from the light source 44 is allowed to reach the line sensor 43 without any obstruction when the recording medium 100 is not present. Accordingly, even the recording medium with perforated lines can be prevented from rising when passing through the guide portion, and therefore it is possible to detect the recording medium reference edge with accuracy. Referring back to FIGS. 8 and 9, the correction roller 40 comprises a correction device drive roller 45 which is driven by a motor (not shown) to drive the surface of the recording medium 100, onto which the toner image is to be transferred, over the whole width (because nothing interferes since image transfer is not performed yet), and a correction device driven roller 46 constructed to be capable of making a difference between the pressing forces applied to opposite ends thereof and applying the pressing force over the whole width of the recording medium 100. The correction device driven roller 46 having been adjusted in accordance with an information on the recording medium reference edge position detected by the line sensor 43 so as to be varied in pressing force depending upon the position widthwise of the recording medium, causes a conveying force to vary with the position in the widthwise direction of the recording medium 100, thereby correcting the shift of the recording medium 100. The recording medium position correction means control device which receives information from the line sensor 43, drives the position correction control motor 47 on the basis of the information as the need arises. A shaft end pulley 48 of the control motor 47 has a wire rope 49 wound thereon, the wire rope 49 extending outwardly from the shaft end pulley 48 in the widthwise direction of the recording medium, so that rotation of the shaft end pulley 48 changes the position of the wire rope 49 at which it is supported by the shaft end pulley 48. A support plate 50 fixed to a frame (not shown) of the correction device extends widthwise of the recording medium to support the position correction control motor 47, and has pulleys 51 for carrying the wire rope 49 fixed near the opposite ends thereof. The wire rope 49 includes built-in spring members 52, 53 between the shaft end pulley 48 and the pulleys 51. The spring members 52, 53 are usually equal in spring tension between the recording medium reference edge side and the side opposite to that of the recording medium reference edge but may be different depending on the situation. The force applied to the both spring members 52, 53 is varied by changing the position where the shaft end pulley 48 is supported, that is, the position of the point of force. The wire rope 49 extending beyond the support plate pulleys 51 is made to pass through arm pulleys 55, mounted on the ends of two arms 54, to which the correction device driven roller 46 is rotatably mounted and each of which extends from the end point of the correction device driven roller 46 in the direction opposite to the recording medium conveying direction, and then through support plate mounting member pulleys 56, fixed to the mounting member for the support shaft 50, to be fixed at the opposite ends thereof to the arms 54, respectively. The support plate mounting member pulleys 56 may be dispensed with, in which case the ends of the wire rope 49 may be fixed to the support plate mounting members. Owing to this construction, as the control motor 47 is rotated, the force applied to the spring members 52, 53 built in the wire rope 49 extending outwardly from the shaft end pulley 48, is changed to make a difference in tensile force of the wire rope 49 between the opposite ends, with the result that the lifting forces applied to the respective arm pulleys 55 are changed in magnitude. An arm fulcrum 58 is fixed halfway between the end point of the correction device driven roller 46 and the arm pulley 55 by a correction device fulcrum shaft 57 fixed to and supported by the correction device frame (not shown), and the arm 54 is pivotally supported on this fulcrum. The arm 54 turns round on the arm fulcrum 58 so as to keep a balance between a repulsion applied to the correction device driven roller 46 by the correction device drive roller 45 and a lifting force applied to the arm pulley 55 by the wire rope 49, and therefore the recording medium 100 is applied with the pressing force by the correction device driven roller 46, the pressing force of which is different between the both ends thereof, thereby performing the skew control for the recording medium so as to restore the moving direction, in which the recording medium 100 tends to skew, to the normal direction.

Figure 11A:
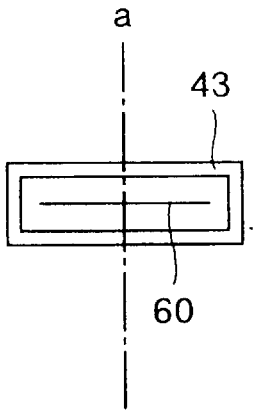
FIGS. 11A to 11C are fragmentary plan views each showing the relation between the line sensor portion and the recording medium in the third embodiment.
Figure 11B:
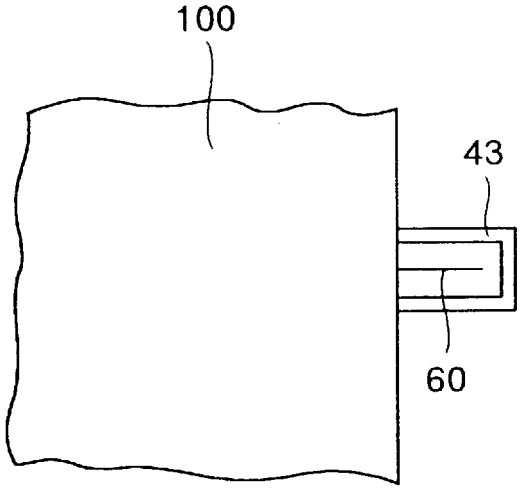
Figure 11C:
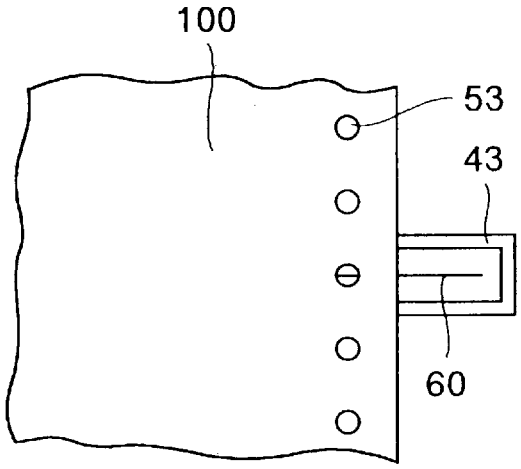
Figure 12A:
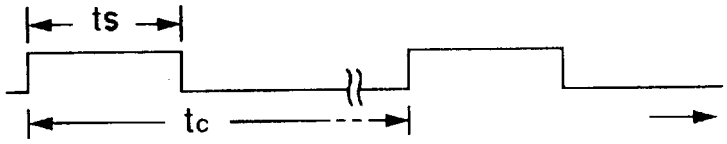
FIGS. 12A to 12E are timing charts showing waveforms of signals detected by and outputted from the line sensor in the respective states of FIGS. 11A to 11C.
Figure 12B:
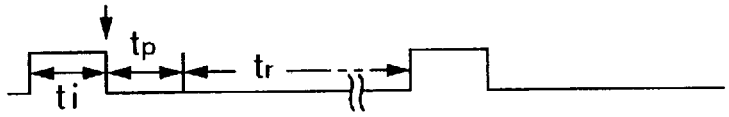
Figure 12C:
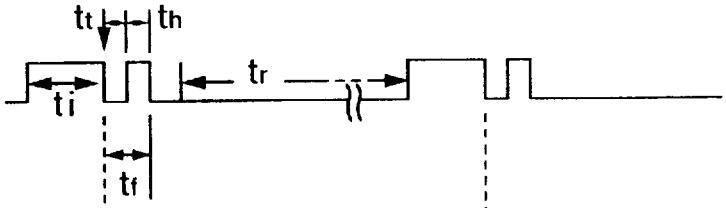
Figure 12D:
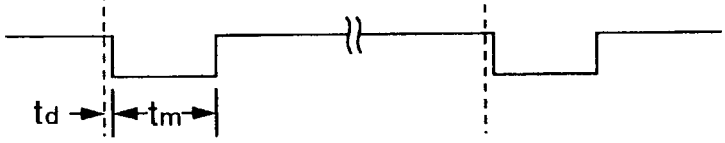
Figure 12E:
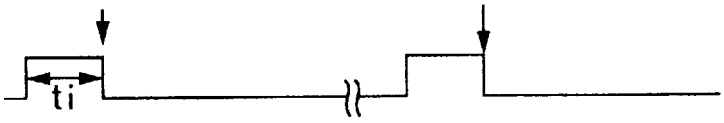

Description will be given in more detail of a method of controlling skew of recording medium in which the correction device driven roller 46 normalizes the moving direction of the recording medium 100 in response to the detected reference edge of the recording medium. When loading the recording medium 100, a driven roller carrier 30 located on the opposite side to the recording medium reference edge is first moved along a driven roller support shaft 29 to the edge of the recording medium opposite to the recording medium reference edge. Then, a driven roller position sensor 33 reads the width of the recording medium and transmits an information on the width of the recording medium to a printer control circuit and a recording medium position correction means control device. At this time, the recording medium reference edge guide 41 is arranged in a position a in FIGS. 9 and 10, that is, a position where the recording medium reference edge is made to pass through the center of the recording medium reference edge position detecting device 42 under the guidance of the recording medium reference edge guide 41, so that the recording medium 100 is allowed to be set in its standard position in the correction roller means 40 of the recording medium position correction device 11. On completing the setting with accuracy, the recording medium reference edge guide 41 is moved by a solenoid (not shown) provided in the bottom thereof to a position b shown in FIG. 10 to be kept away from the recording medium widthwise regulation position. The line sensor 43 provided in the upstream portion of the recording medium position correction device 11 outputs a binary coded signal waveform shown in FIG. 12A when the recording medium 100 is not present as shown in FIG. 11A. Namely, the line sensor 43 outputs a signal with a sensing width of $t_s$ sec per sensing cycle $t_c$ sec thereof. As shown in FIG. 11B, in the case where the recording medium 100 with no sprocket hole is set and the recording medium reference edge is made to pass through the center of the line sensor, that is, the position a, in the waveform of the output signal of the line sensor, a signal is turned ON during the initial exposure time of $t_i$ sec from the starting point of the sensing cycle to the point corresponding to the position a, and then turned OFF during the hidden sensing time of $t_p$ sec till the line sensor detection is finished and during the sensing quiescent time of $t_r$ sec, as shown in FIG. 12B. As shown in FIG. 11C, if the recording medium 100 with sprocket holes is set and the sensing operation is performed in a state where the recording medium reference edge is in the position a and one of the sprocket holes 59 is on a sensing line 60 of the line sensor, a signal waveform shown in FIG. 12C is detected. Namely, a signal is turned ON during the normal initial exposure time of $t_i$ sec from the starting point of the sensing cycle, turned OFF during the following temporary hidden sensing time of $t_t$ sec, then, when approaching the sprocket hole, turned ON during the hole exposure time of $t_h$ sec because the hole allows the light to pass through it, and thereafter turned OFF again. According to this signal, it is impossible to specify the position of the recording medium edge since there are two fall signals indicative of the recording medium edge. For this reason, in this embodiment, a line sensor output processing means is used so that, on detecting a fall signal, a negative pulse with a pulse width of $t_m$ sec is generated using the detected fall signal as trigger while not using other fall in the waveform of the signal detected in this duration as trigger. In this way, a signal waveform shown in FIG. 12D is newly generated. A signal waveform shown in FIG. 12E, obtained as a result of the logical product (AND) of the output signal of the line sensor and the generated signal shown in FIG. 12D, becomes an output signal waveform of the line sensor output processing means. In order to obtain the waveform of FIG. 12E identical with the waveform of FIG. 12B for the waveform of FIG. 12C as described above, the following relations must be kept:

$$td<MIN\ t_t$$

$$\text{MAX } t_f<t_m+t_d<t_c-t_i$$

where $t_f$ is a fluctuation time (sec) and meets $t_f=t_t+t_h$, and $t_d$ is a negative pulse generation delay time (sec). However, the negative pulse generation delay time $t_d$ is negligible, and therefore it can be said that $t_d<\text{MIN } t_t$ holds at all times. When processing the output signal waveform of FIG. 12B, the output of the line sensor output processing means becomes a signal waveform of FIG. 12E as well. In the waveforms of FIGS. 12B, 12C and 12E, the first fall point is shown as a point corresponding to the position a, and however if the position of the recording medium reference edge becomes out of the position a, the initial exposure time $t_i$ changes from the value shown in the drawing and an amount of this change is detected as a shift of the recording medium reference edge.

Figure 13:
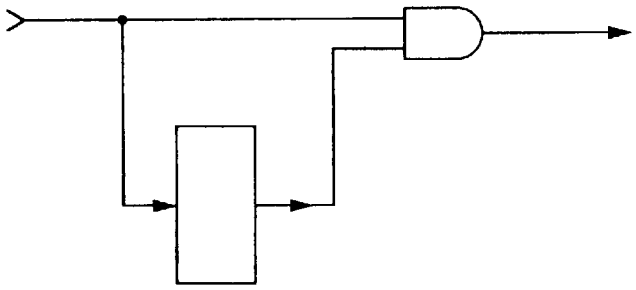
FIG. 13 is a circuit diagram showing an example of the structure of a line sensor output circuit according to the third embodiment.

FIG. 13 shows an example of an electronic circuit which outputs the signal waveform of FIG. 12E. The line sensor output of FIGS. 12B and 12C is inputted into an AND gate 66 and a trigger input terminal of a multivibrator 65. An example of the multivibrator can be made up of timing generating parts including TTL IC chip HD74LS221 made by Hitachi Ltd., condenser and resistance. The output of the multivibrator is a negative pulse shown in FIG. 12D having a pulse width set by the timing generating parts, which pulse is inputted into the AND gate 66 so that a line sensor output shown in FIG. 12E is obtained. Incidentally, it has been suggested in the above description that the fall in waveform of the signal detected by the line sensor while the negative pulse was being generated, should not be used as trigger, and however it is possible to use as trigger the two falls in waveform of the line sensor output signal, provided that $\text{MAX } t_f<t_m+t_d<t_c-\text{MAX } t_f-t_i$ is satisfied. In this case, however, the negative pulse width becomes longer than that in the waveform of FIG. 12D for the line sensor output signal having the waveform of FIG. 12C.

Figure 14A:
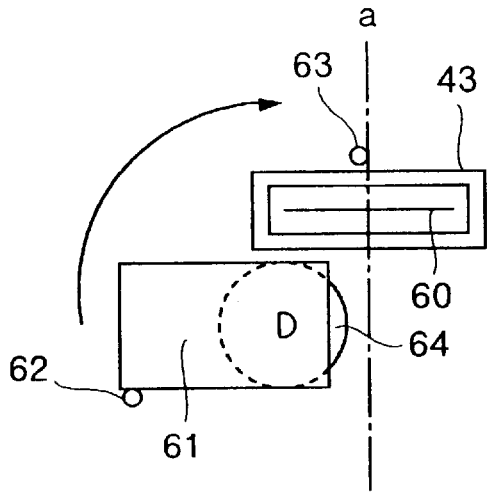
FIGS. 14A to 14C are fragmentary plan views each showing the relation between a line sensor portion and the recording medium in a fourth embodiment of the invention.
Figure 14B:
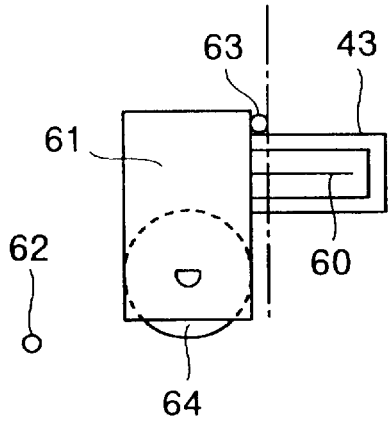
Figure 14C:
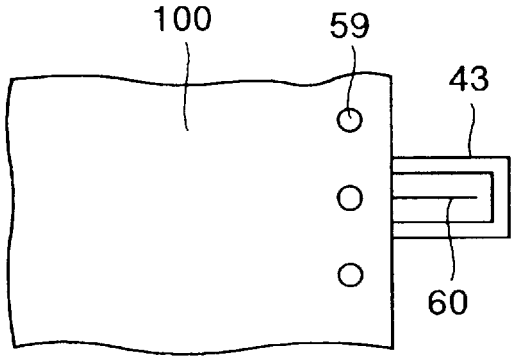

A fourth embodiment of the present invention will be described with reference to FIGS. 14A to 14C. The line sensor 43 is similar to that in the third embodiment, and a mask 61, by which a detection window of the line sensor 43 is partially shielded and exposed, is swingably disposed between the line sensor 43 and the recording medium 100. Mask stoppers 62, 63 are provided for limiting the range of rotation of the mask. The line sensor mask 61 is swung between the both mask stoppers 62 and 63 by means of a mask driving motor 64. FIG. 14A shows a state in which the line sensor detection window is exposed and the line sensor mask 61 is rotatable in a direction indicated by an arrow. FIG. 14B shows a state in which the line sensor detection window is partially shielded by rotating the line mask 61 in the direction indicated by an arrow of FIG. 14A. In this state, if the recording medium 100 is fed into as shown in FIG. 14C, the sprocket holes 59 formed in the recording medium are masked by the line sensor mask 61, with the result that the line sensor 43 is brought into the same state as that shown in FIG. 11B in which the recording medium 100 with no sprocket hole is made to pass.

In this embodiment, the line sensor mask 61 is made of a magnetic thin sheet and fixed at one end thereof to a rotary shaft of the mask driving motor 64 so as to be rotated within a range of an angle of 90° by the mask driving motor 64. Both the mask stoppers 62 and 63 are made of a permanent magnet to attract and hold the line sensor mask 61. In the case where The recording medium is formed with the sprocket holes 59 as shown in FIGS. 11C and 14C, the line sensor mask 61 is held by the mask stopper 63 while partially shielding the line sensor detection window as shown in FIG. 14B. However, in the case where the recording medium is formed with no sprocket hole 59 as shown in FIG. 11B, the line sensor mask 61 is held by the mask stopper 62 so that the line sensor 43 is used with the detection window being exposed as shown in FIG. 14A. with this construction, the line sensor becomes able to output the detection signal of FIG. 12B at all times without processing the output signal.

Further, in the case where a space of not less than a certain value is ensured between the recording medium sprocket hole 59 and the recording medium reference edge, it also is possible to use the line sensor 43 with the detection window being partially shielded at all times by fixing adjustably the line sensor mask 61 to the underside of, for example, the central recording medium guide, as by means of screwing. In this case, the line sensor mask 61 may be made of any kind of material, provided that there are ensured a certain degree of rigidity and a high accuracy, with which a side to be arranged substantially parallel with the recording medium reference edge is arranged. Moreover, the line sensor mask 61 may be arranged above the upper recording medium guide, provided that it is disposed between the light source 44 and the line sensor 43.

According to the present invention, since at least one of the recording medium conveying means is provided downstream of the transfer section with respect to the recording medium conveying direction, when transferring a toner image from the image recording section to the recording medium, the friction conveyance can be reliably performed against the attraction between the toner image forming member and the recording medium, and since the friction conveyance is performed by means of two rollers located at both edges of the recording medium which are outside the image transfer area, the friction conveyance can be performed without disturbing the unfixed image on the recording medium.

Further, in the friction-conveying means provided downstream of the transfer section with respect to the recording medium conveying direction, two driven rollers are pressed against the drive roller independently of each other, and therefore it is possible to make the set pressing forces for the two rollers equal to each other without difficulty, with the result that the skew of recording medium attributed to the pressing force imbalance is done away with.

Moreover, the friction conveyance can be performed with reliability against the attraction in the transfer section between the toner image forming member and the recording medium, provided that the set pressing force for the two driven rollers disposed downstream of the transfer section with respect to the recording medium conveying direction is not less than $\mu d \cdot Fq/(\mu r \cdot \cos\theta)$.

A method of detecting the position of recording medium reference edge by making use of a high-accuracy optical detection device according to the present invention, makes it possible to detect exactly the position of the recording medium reference edge and hence to correct the skew of the recording medium with a high accuracy whether the sprocket holes are formed or not. Further, since there is adopted such a recording medium guide that can prevent the recording medium from rising, even the recording medium with perforated lines can undergo normal recording medium skew correction because the position of its reference edge can be detected with a high accuracy as well.

What is claimed is:

1. In an image forming apparatus comprising recording medium conveying means for friction-conveying a continuous recording medium, an image recording section for forming electrostatically a toner image, and a transfer section for transferring said toner image to said recording medium, the improvement wherein said recording medium conveying means includes friction-conveying means provided downstream of said transfer section with respect to a recording medium conveying direction for interposing therebetween and conveying said recording medium, and further comprising a line sensor for detecting a position where a reference edge of said recording medium is present, a recording medium position correction means control device for outputting a control signal in association with said line sensor, and recording medium position correction means disposed upstream of said image recording section with respect to the recording medium conveying direction for correcting a position of a recording medium edge on receiving a signal from said recording medium position correction means control device.

2. In an image forming apparatus comprising recording medium conveying means for friction-conveying a continuous recording medium, an image recording section for forming electrostatically a toner image, and a transfer section for transferring said toner image to said recording medium, the improvement wherein said recording medium conveying means includes friction-conveying means for interposing therebetween and conveying said recording medium, which is provided downstream of said transfer section with respect to a recording medium conveying direction and comprises two rollers contacting only on both edges of said recording medium which are outside an image transfer area and a roller disposed on a back side of a surface of said recording medium onto which an image is to be transferred.

3. In an image forming apparatus comprising recording medium conveying means for friction-conveying a continuous recording medium, an image recording section for forming electrostatically a toner image, and a transfer section for transferring said toner image to said recording medium, the improvement wherein said recording medium conveying means includes friction-conveying means for interposing therebetween and conveying said recording medium, which is provided downstream of said transfer section with respect to a recording medium conveying direction and comprises two rollers contacting only both edges of said recording medium which are outside an image transfer area and a roller disposed on a back side of a surface of said recording medium onto which an image is to be transferred, said two rollers, respectively, have pressing means by which said two rollers are pressed against said roller.

4. An image forming apparatus according to claim 3, wherein each of said pressing means has a pressing force adjusting means.

5. In an image forming apparatus comprising an image recording section including a photosensitive member on which a toner image is formed electrophotographically, a charging member for uniformly charging said photosensitive member, an optical member for forming an electrostatic latent image on said photosensitive member and a developing member for developing said latent image with toner to provide a toner image, recording medium conveying means for friction-conveying a continuous recording medium, and a transfer section for transferring said toner image to said recording medium, the improvement wherein said recording medium conveying means includes friction-conveying means for interposing therebetween and conveying said recording medium, which is provided downstream of said transfer section with respect to a recording medium conveying direction and comprises two rollers located on both edges of said recording medium which are outside an image transfer area and a roller disposed on a back side of a surface of said recording medium onto which an image is to be transferred, said two rollers each have pressing means by which said two rollers are pressed against said roller, and each of said pressing means has a pressing force of not less than $\mu d \cdot Fq/(\mu r \cdot \cos\theta)$ relative to an attraction Fq between said recording medium and said photosensitive member, on an assumption that $\theta$ is an angle between a tangential direction of said photosensitive member and said recording medium conveying direction in said transfer section, $\mu d$ is a coefficient of friction between said recording medium and said photosensitive member, and $\mu r$ is a coefficient of friction between said recording medium and said roller.

6. An image forming apparatus according to one of claims 2 to 5, wherein at least one of said two rollers located on both edges is a movable roller which is movable widthwise of said recording medium, and a sensor is provided for detecting a position of said movable roller.

7. An image forming apparatus comprising:

a line sensor for detecting a position where a reference edge of a recording medium is present;

line sensor output processing means which judges the position of said reference edge of said recording medium in cooperation with said line sensor to provide a recording medium reference edge position signal;

a recording medium position correction means control device which finds a recording medium position correction value from an output of said line sensor output processing means to output a control signal; and recording medium position correction means disposed upstream of an image recording section with respect to a recording medium conveying direction for correcting the position of said reference edge on receiving said control signal from said recording medium position correcting means control device.

8. An image forming apparatus according to claim 7, wherein said line sensor comprises photoelectric conversion means and is arranged substantially perpendicularly to the recording medium conveying direction, and said line sensor output processing means outputs, on sensing a presence of a recording medium leading edge within a sensing cycle of said line sensor, a recording medium edge position signal.

9. An image forming apparatus comprising:

a line sensor disposed upstream of an image recording section with respect to a recording medium conveying direction for detecting a position where a reference edge of a recording medium is present;

mask means adjustable in position for shielding a portion of a detection window of said line sensor;

a recording medium position correction means control device which finds a recording medium position correction value from an output of said line sensor to output a control signal; and recording medium position correction means disposed upstream of the image recording section with respect to the recording medium conveying direction for correcting a position of said reference edge on receiving said control signal of said recording medium position correction means control device.

10. An image forming apparatus according to claim 9, wherein said mask means is moved switchingly between a state in which said detection window is partially shielded, and a state in which said detection window is exposed.

11. An image forming apparatus according to one of claims 7 to 10, further comprising recording medium conveying means having means by which a width of said recording medium is detected and transmitted to said recording medium position correction means control device, and mainly performing conveyance of said recording medium, said recording medium position correction means comprising a driven roller by which a value of an applied pressure is varied widthwise of the recording medium, arms extending from opposite ends of said driven roller to be able to pivot on respective fulcrums, and a length of cord stretched between the opposite ends of said driven roller with two springs built therein, such that a difference between forces applied to points of force located at distal ends of said arms is adjusted by adjusting a position of a point of force located between said springs.

12. An image forming apparatus according to one of claims 7 to 10, further comprising a guide for preventing any error from being generated in detection of a position of said reference edge attributed to rising of said recording medium near a sensing position of said line sensor.

13. An image forming apparatus according to claim 7, further comprising recording medium conveying means having means by which a width of said recording medium is detected and transmitted to said recording medium position correction means control device, and mainly performing conveyance of said recording medium, said recording medium position correction means comprising a driven roller by which a value of an applied pressure is varied widthwise of the recording medium, arms extending from opposite ends of said driven roller to be able to pivot on respective fulcrums, and a length of cord stretched between the opposite ends of said driven roller with two springs built therein, such that a difference between forces applied to points of force located at distal ends of said arms is adjusted by adjusting a position of a point of force located between said springs, and further comprising a guide for preventing any error from being generated in detection of a position of said reference edge attributed to rising of said recording medium near a sensing position of said line sensor.

14. An image forming apparatus according to claim 9, further comprising recording medium conveying means having means by which a width of said recording medium is detected and transmitted to said recording medium position correction means control device, and mainly performing conveyance of said recording medium, said recording medium position correction means comprising a driven roller by which a value of an applied pressure is varied widthwise of the recording medium, arms extending from opposite ends of said driven roller to be able to pivot on respective fulcrums, and a length of cord stretched between the opposite ends of said driven roller with two springs build therein, such that a difference between forces applied to points of force located at distal ends of said arms is adjusted by adjusting a position of a point of force located between said springs, and further comprising a guide for preventing any error from being generated in detection of a position of said reference edge attributed to rising of said recording medium near a sensing position of said line sensor.

15. An image forming apparatus according to claim 7, wherein said line sensor comprises photoelectric conversion means and is arranged substantially perpendicularly to said recording medium conveying direction, and said line sensor output processing means outputs, on sensing a presence of a recording medium leading edge within a sensing cycle of said line sensor, a recording medium edge position signal, said apparatus further comprising recording medium conveying means having means by which a width of said recording medium is detected and transmitted to said recording medium position correction means control device, and mainly performing conveyance of said recording medium, said recording medium position correction means comprising a driven roller by which a value of an applied pressure is varied widthwise of the recording medium, arms extending from opposite ends of said driven roller to be able to pivot on respective fulcrums, and a length of cord stretched between the opposite ends of said driven roller with two springs built therein, such that a difference between forces applied to points of force located at distal ends of said arms is adjusted by adjusting a position of a point of force located between said springs, and further comprising a guide for preventing any error from being generated in detection of a position of said reference edge attributed to rising of said recording medium near a sensing position of said line sensor.

16. An image forming apparatus according to claim 9, wherein said mask means is moved switchingly between a state in which said line sensor detection window is partially shielded, and a state in which said window is exposed, said apparatus further comprising recording medium conveying means having means by which a width of said recording medium is detected and transmitted to said recording medium position correction means control device, and mainly performing conveyance of said recording medium, said recording medium position correction means comprising a driven roller by which a value of an applied pressure is varied widthwise of the recording medium, arms extending from opposite ends of said driven roller to be able to pivot on respective fulcrums, and a length of cord stretched between the opposite ends of said driven roller with two springs built therein, such that a difference between forces applied to points of force located at distal ends of said arms is adjusted by adjusting a position of a point of force located between said springs, and further comprising a guide for preventing any error from being generated in detection of a position of said reference edge attributed to rising of said recording medium near a sensing position of said line sensor.

* * * * *